US007896777B2

(12) United States Patent
Huang et al.

(10) Patent No.: US 7,896,777 B2
(45) Date of Patent: Mar. 1, 2011

(54) MULTI-DIMENSIONAL ARM AND WRIST TRAINING DEVICE CAPABLE OF CHANGING WEIGHT

(75) Inventors: Cheng-Hsun Huang, Changhua County (TW); Chi-Xiang Shi, Taichung County (TW)

(73) Assignee: B. Green Technology Co., Ltd., Changhua County (TW)

( * ) Notice: Subject to any disclaimer, the term of this patent is extended or adjusted under 35 U.S.C. 154(b) by 38 days.

(21) Appl. No.: 12/335,419

(22) Filed: Dec. 15, 2008

(65) Prior Publication Data

US 2010/0075811 A1 Mar. 25, 2010

(51) Int. Cl.
*A63B 23/14* (2006.01)
*A63B 21/072* (2006.01)

(52) U.S. Cl. ..... 482/46; 482/108

(58) Field of Classification Search ..... 482/46, 482/139, 148, 106–109, 44–45; 601/8
See application file for complete search history.

(56) References Cited

U.S. PATENT DOCUMENTS

| | | | | | |
|---|---|---|---|---|---|
| 2,920,418 | A | * | 1/1960 | Britt | 446/241 |
| 3,033,565 | A | * | 5/1962 | Wolski | 482/46 |
| 3,708,164 | A | * | 1/1973 | Griffin | 482/46 |
| 3,938,803 | A | * | 2/1976 | Wilmoth et al. | 482/132 |
| 4,165,070 | A | * | 8/1979 | Rice | 482/46 |
| 4,309,028 | A | * | 1/1982 | Finizza | 482/83 |
| 4,344,615 | A | * | 8/1982 | Carlson | 482/46 |
| 4,392,649 | A | * | 7/1983 | Chapman | 482/46 |
| 4,531,729 | A | * | 7/1985 | Wrinkle | 482/106 |
| 4,618,143 | A | * | 10/1986 | Twardosz | 482/106 |
| 4,629,184 | A | * | 12/1986 | Selkee | 482/106 |
| 4,690,400 | A | * | 9/1987 | Metz | 482/106 |
| D305,256 | S | * | 12/1989 | Pearson | D21/682 |
| 5,080,349 | A | * | 1/1992 | Vittone | 482/106 |
| 5,211,616 | A | * | 5/1993 | Riley, Jr. | 482/106 |
| 5,259,824 | A | * | 11/1993 | Cheltenham | 482/114 |
| 5,474,511 | A | * | 12/1995 | Dantolan | 482/93 |
| 5,547,441 | A | * | 8/1996 | Mora | 482/46 |
| 5,556,368 | A | * | 9/1996 | Akin | 482/124 |
| 5,967,949 | A | * | 10/1999 | Davenport | 482/93 |
| 6,174,269 | B1 | * | 1/2001 | Eschenbach | 482/132 |
| 6,338,702 | B1 | * | 1/2002 | Jordan | 482/108 |
| 7,094,186 | B2 | * | 8/2006 | Diakonov et al. | 482/104 |
| 2004/0082448 | A1 | * | 4/2004 | Martin | 482/139 |
| 2006/0040802 | A1 | * | 2/2006 | Vittone et al. | 482/106 |
| 2008/0020913 | A1 | * | 1/2008 | Wilson et al. | 482/139 |
| 2008/0026920 | A1 | * | 1/2008 | Berenshteyn | 482/106 |

* cited by examiner

*Primary Examiner*—Rinaldi I Rada
*Assistant Examiner*—Robert F Long
(74) *Attorney, Agent, or Firm*—Browdy and Neimark, PLLC

(57) ABSTRACT

A multi-dimensional training device for training arm and wrist and capable of changing weight includes a connection member, a first turning member connected to the connection member, a first handle pivoted on the first turning member, a second turning member pivoted on the connection member, and a second handle pivoted on the second turning member. The second turning member may be disassembled to mount weight member on the connection member or take the weight member off from the connection member. User may hold the first and second handles to turn or move the training device of the present invention for training more muscles and joints.

4 Claims, 7 Drawing Sheets

MULTI-DIMENSIONAL ARM AND WRIST TRAINING DEVICE CAPABLE OF CHANGING WEIGHT

BACKGROUND OF THE INVENTION

1. Field of the Invention

The present invention relates to a training device and more particularly, to a multi-dimensional arm and wrist training device capable of changing weight.

2. Description of the Related Art

In weight training, dumbbells are the most common devices to train muscles. Typically, the conventional dumbbell has a bar and two iron blocks on opposite ends of the bar. User holds the bar for various arm and wrist exercises, such as flexion, extension, pronation, and supination. Basically, the every exercise trains the specific muscle, such as elbow's flexion trains bicep.

However, the dumbbell's training only trains one or a few muscle in a single exercise. It can not provide a total exercise of arm and wrist.

SUMMARY OF THE INVENTION

The primary objective of the present invention is to provide a multi-dimensional arm and wrist training device, which may train more muscles in a single exercise.

To achieve the objective of the present invention, a multi-dimensional training device includes a connection member, a first turning member connected to the connection member, a first handle pivoted on the first turning member, a second turning member pivoted on the connection member, and a second handle pivoted on the second turning member. User may hold the first and second handles to turn or move the training device of the present invention for training more muscles and joints.

DETAILED DESCRIPTION OF THE INVENTION

Figure 1:
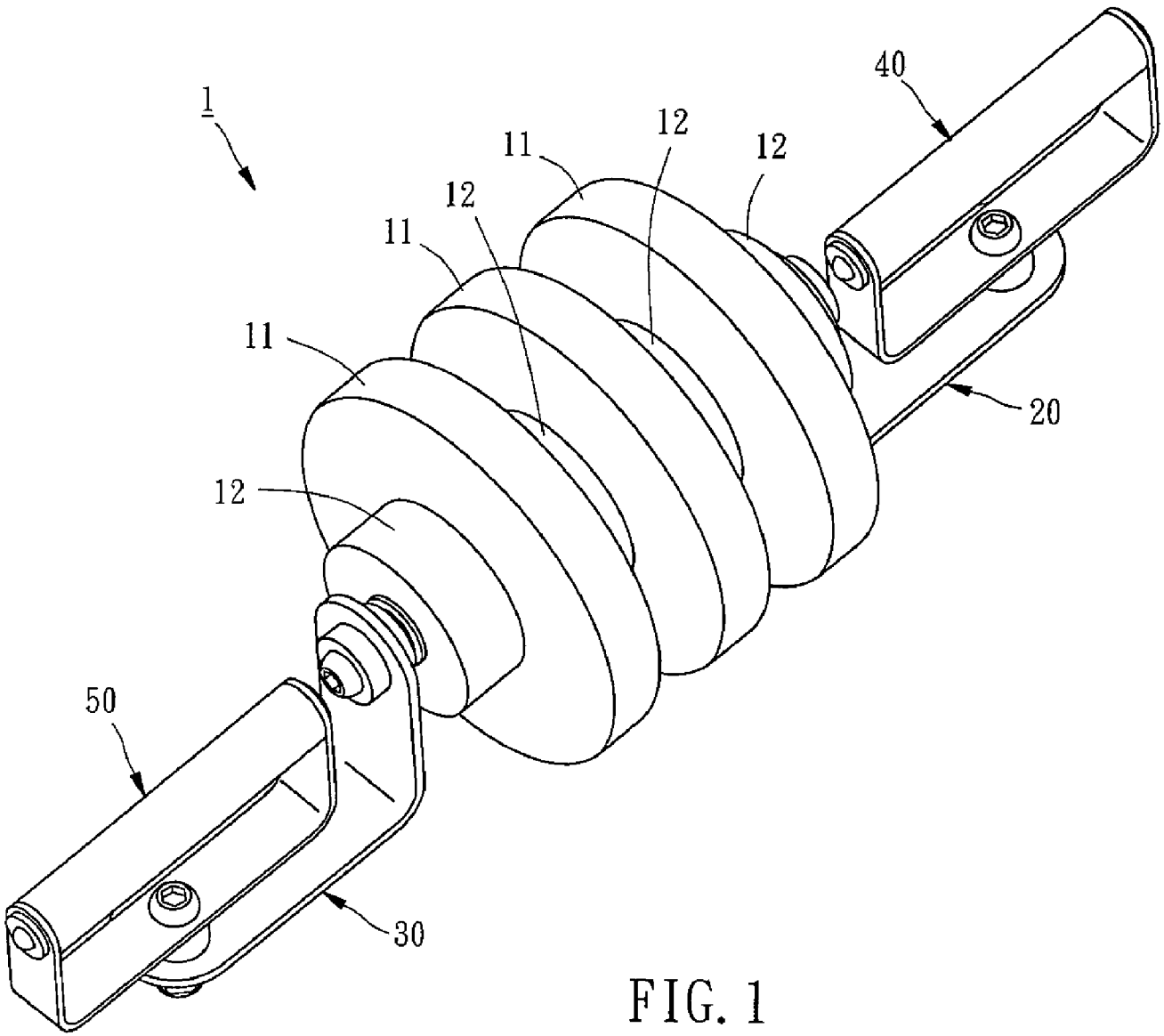
FIG. 1 is a perspective of a first preferred embodiment of the present invention.
Figure 2:
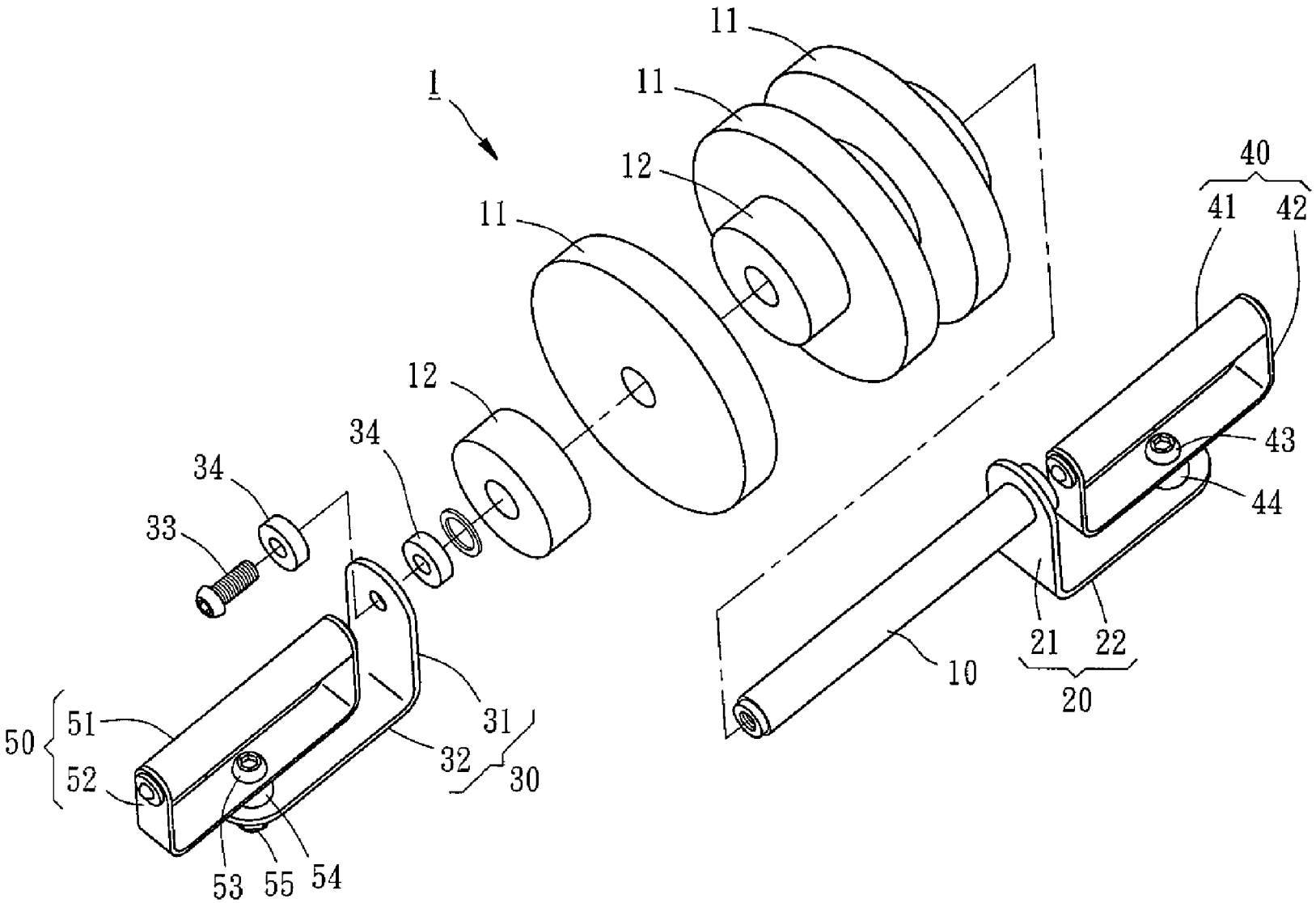
FIG. 2 is an exploded view of the first preferred embodiment of the present invention.
Figure 3:
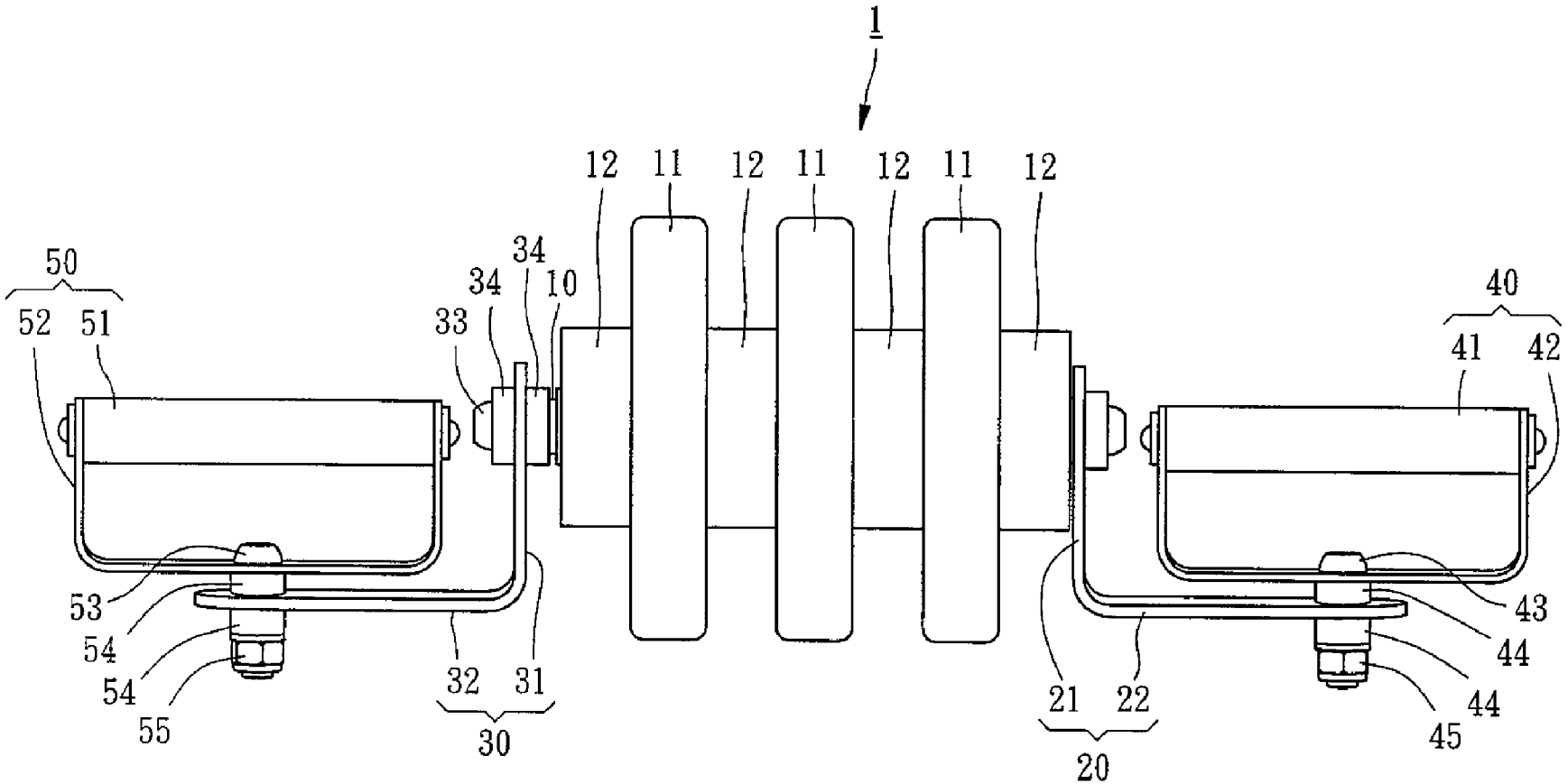
FIG. 3 is a top view of the first preferred embodiment of the present invention.
Figure 4:
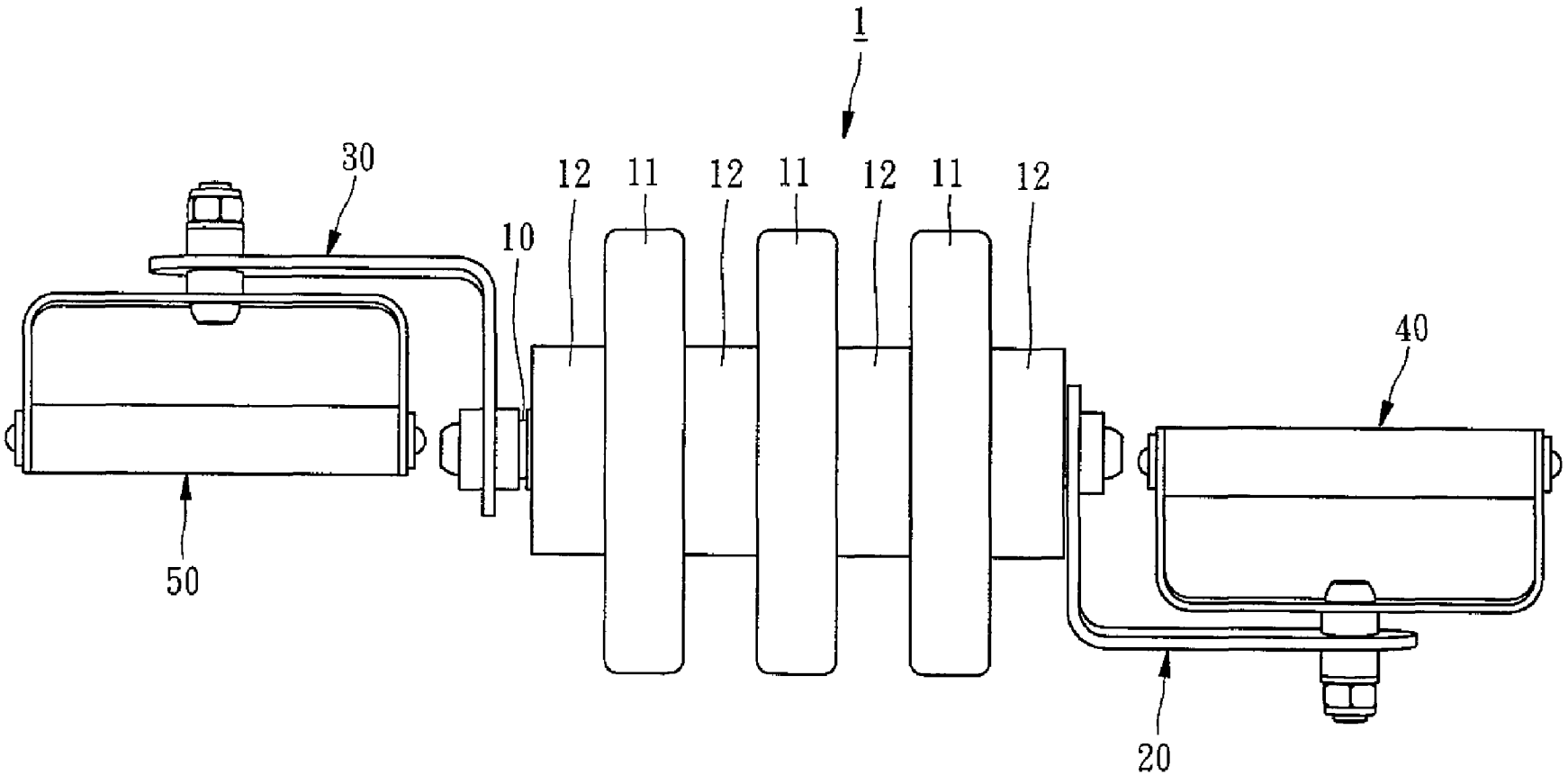
FIG. 4 is a top view of the first preferred embodiment of the present invention, showing the second turning member rotating.

Referring to FIGS. 1 to 3, a multi-dimensional training device 1 of the first preferred embodiment of the present invention includes a connection member 10, a first turning member 20, a second turning member 30, a first handle 40, and a second handle 50.

The connection member 10 is a straight bar, on which weight members 11 are mounted. The first turning member 20 is an L-shaped plate, which is defined as a first section 21 and a second section 22. The first section 21 of the first turning member 20 is fixed to an end of the connection member 10 by a bolt. Same as the first turning member 20, the second turning member 30 is an L-shaped plate also, and is defined as a first section 31 and a second section 32. A bolt 33 is inserted through the first section 31 of the second turning member 30 and is screwed into the other end of the connection member 10. Thrust bearings 34 are fitted to the bolt 33 on opposite sides of the first section 31 that the second turning member is free for rotation relative to the connection member 10. The first handle 40 has a bar 41 and a U-shaped frame 42. The frame 42 of the first handle 40 is connected to the second section 22 of the first turning member 20 by a bolt 43 and nut 45. Thrust bearing 44 are fitted to the bolt 43 on opposite sides of the second section 22 that the first handle 40 is free for rotation relative to the first turning member 20. Same as above, the second handle 50 has a bar 51 and a U-shaped frame 52. The frame 52 of the second handle 50 is connected to the second section 32 of the second turning member 30 by a bolt 53 and nut 55. Thrust bearing 54 are fitted to the bolt 53 on opposite sides of the second section 32 that the second handle 50 is free for rotation relative to the second turning member 30.

To change weight of the training device 1 of the present invention, one may loose the nut 33 to take off the second turning member 30 that it may fit weight members 11 to the connection member 10 or take the weight member 11 off from the connection member 10. To avoid movements of the weight member 11 on the connection member 10, it may provide cushion members 12 between the weight members 11. The cushion members 12 are rubber or foamed rings fitted to the connection member 10.

To take exercise by the training device 1 of the present invention, user may hold the first and second handles 40, 50 to turn or move the training device 1 of the present invention freely. Except for the common dumbbell training, the training device 1 of the present invention may provide various limb and joint exercises including wrist, forearm, upper arm, elbow, and shoulder. Much more muscles may be trained by the training device 1 of the present invention. The thrust bearings 34, 44, 54 may be replaced by pads or washers that it may provides resistance in turning of the handles 40, 50 and the second turning member 30. The resistance may be adjusted by turn tight or loose the bolt 33, 43, 53.

Figure 5:
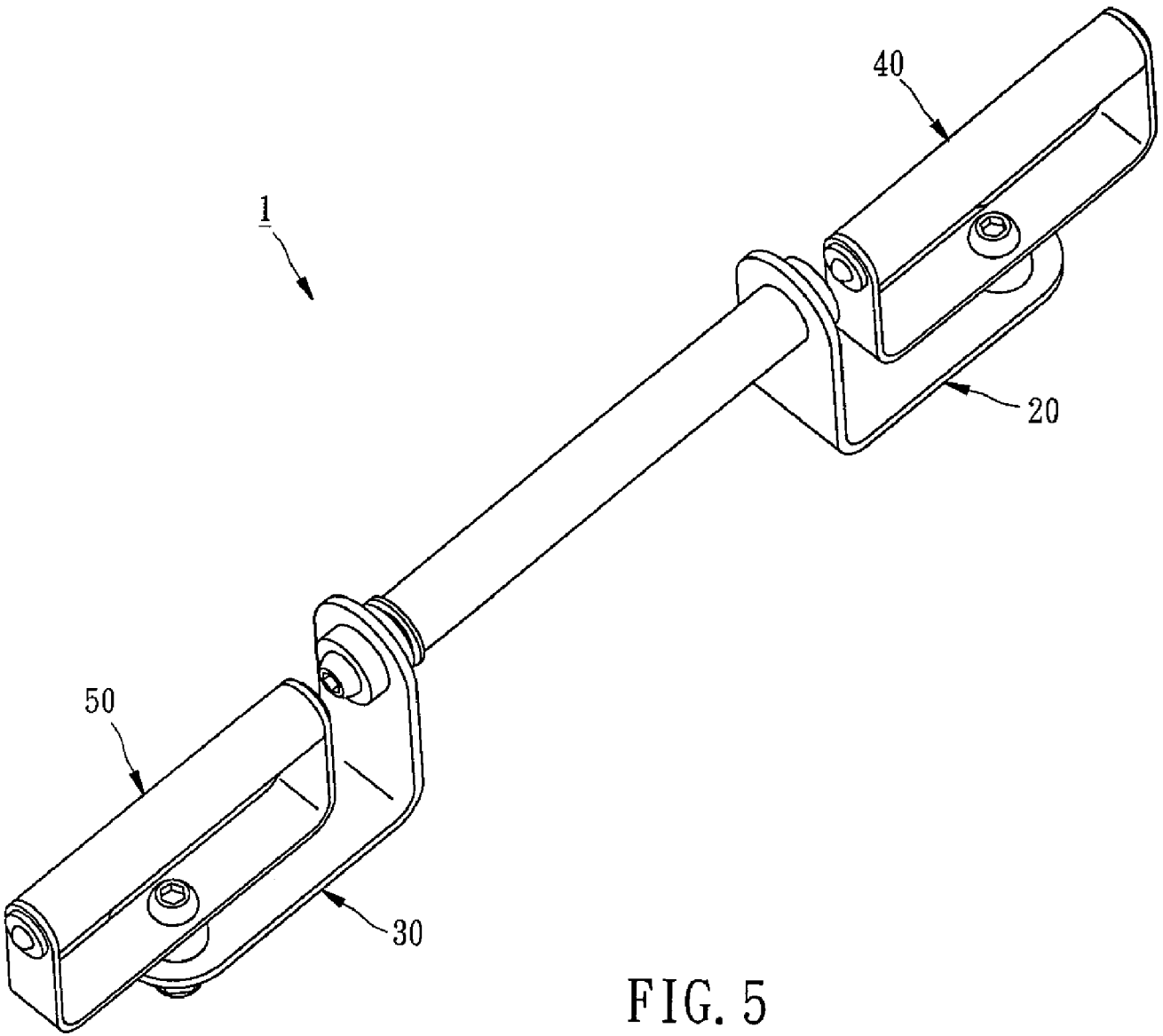
FIG. 5 is a perspective view of the first preferred embodiment of the present invention, showing no weight member on the connection member.
Figure 6:
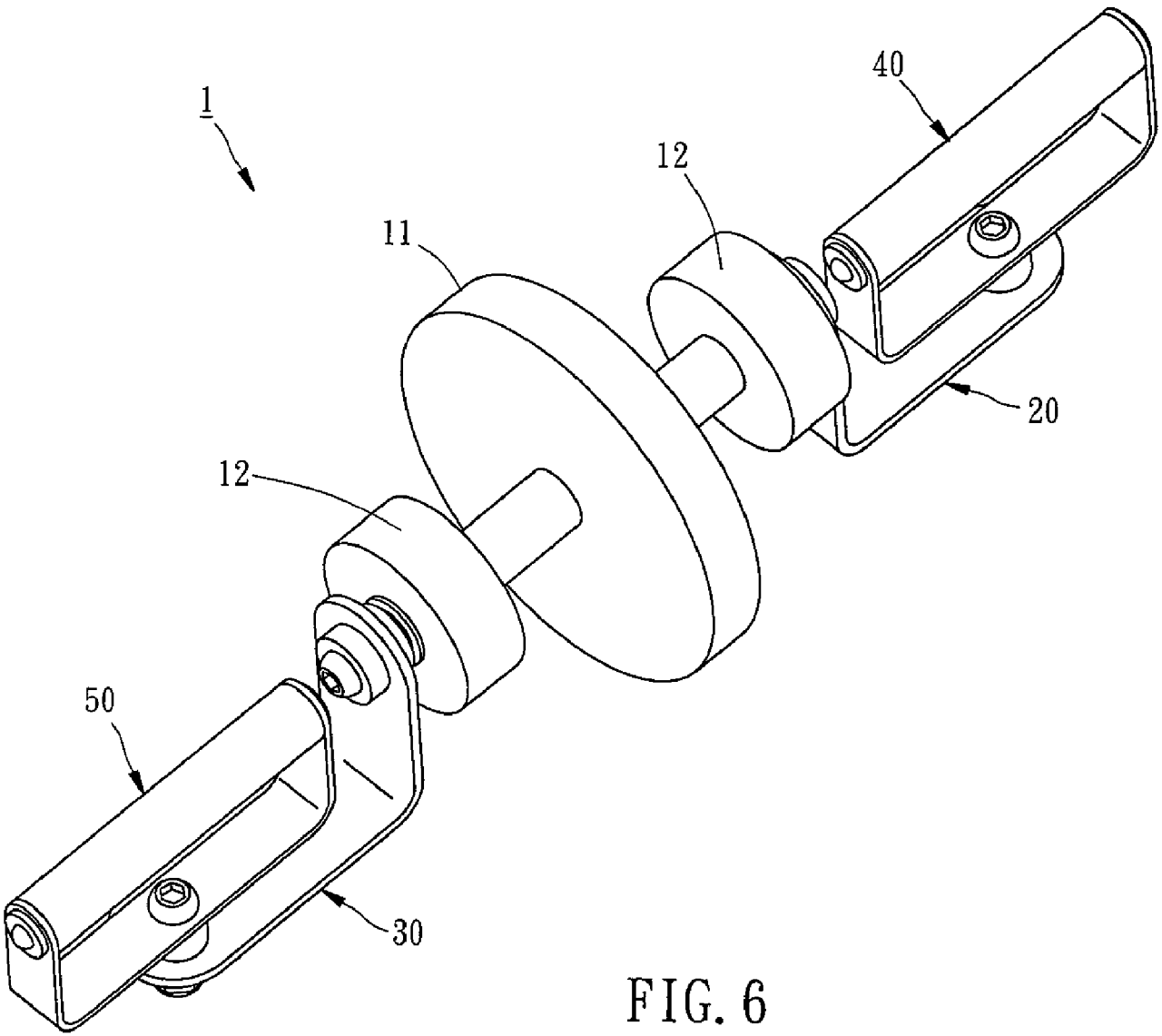
FIG. 6 is a perspective view of the first preferred embodiment of the present invention, showing only one weight member on the connection member.

User may increase or decrease the weight members 11 on the connection member 10. FIG. 5 shows no weight member on the connection member 10. FIG. 6 shows only one weight member 11 and two cushion members 12 on the connection member 10 that the weight member 11 and the cushion members 12 may slid along the connection member 10 in exercise.

The characters and advantages of the present invention are:

1. The weight members are between the handles. Compare to the dumbbell having the weight member on opposite ends, the present invention may have a better balance in exercise. Besides, the present invention has no extruded bars on opposite ends that provides a better completeness.

2. The connection member 10 is the common rotation axis of the first turning member 20 and the second turning member 30 that the second turning member 30 may turn to the opposite side relative to the first turning member 20. It provides more ranges of motion to training muscles and joints.

3. Rotations of the first handle 40 and second handle 50 are orthogonal to the first turning member 20 and the second turning member 30 respectively. It may exercise more muscles and joints.

Figure 7:
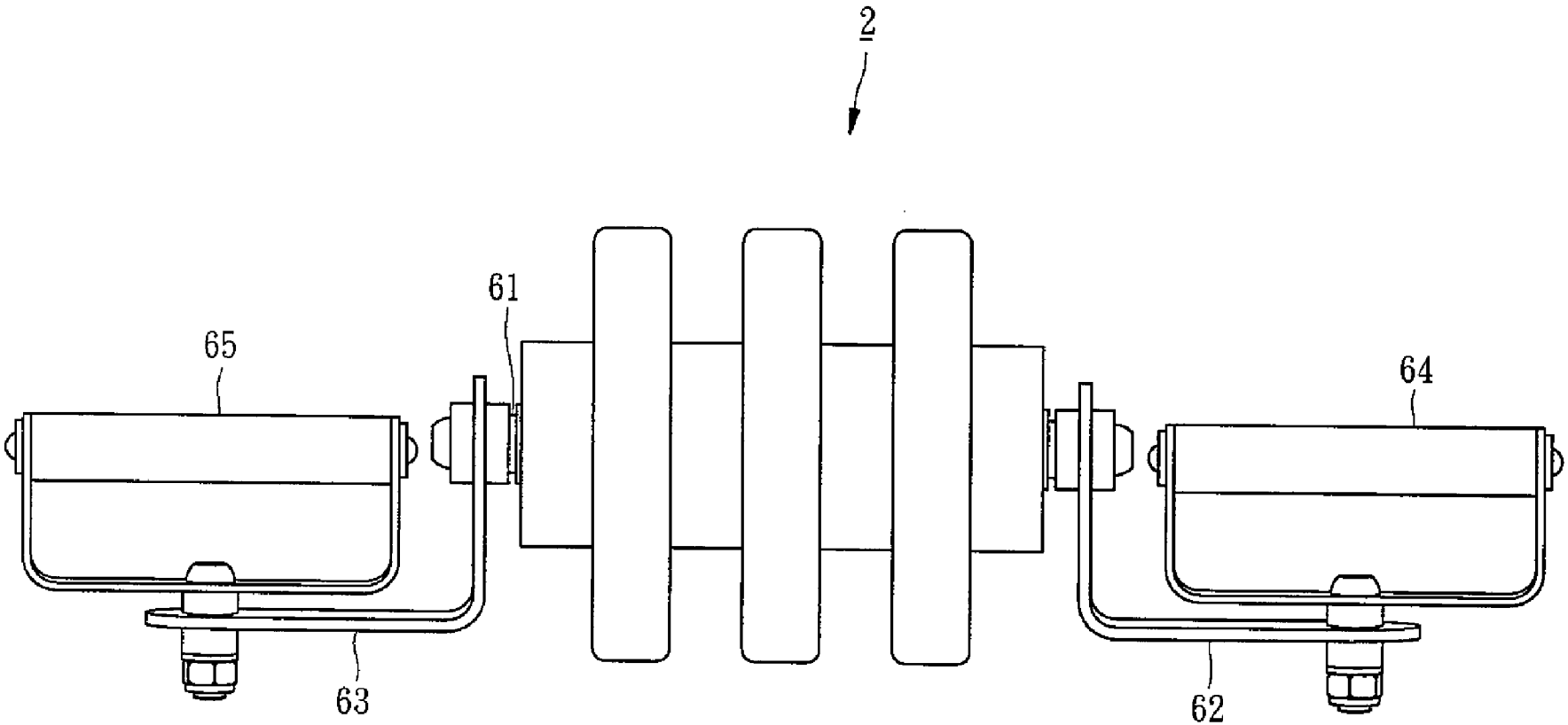
FIG. 7 is a top view of a second preferred embodiment of the present invention.

FIG. 7 shows a training device 2 of the second preferred embodiment of the present invention. The training device 2 includes a connection member 61, a first turning member 62, a second turning member 63, a first handle 64, and a second handle 65. The different part of the second preferred embodiment is that both of the first turning member 62 and second turning member 63 are pivoted on the connection member 61. In other words, the first turning member 62 and second turning member 63 are independently rotatable relative to the connection member 61. The functions and advantages of the second preferred embodiment are as same as the first preferred embodiment.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multi-dimensional training device, comprising:

a connection member;

a first turning member connected to a first end of the connection member so as to be rotational during exercise use;

a first handle pivotably connected to the first turning member for free rotation of the first handle relative to the first turning member;

a second turning member connected about a first axis to a second end of the connection member for free rotation during exercise use of the second turning member relative to the connection member;

a second handle pivotably connected about a second axis to the second turning member for free rotation of the second handle relative to the second turning member; and weighted members between the turning members, wherein the second axis, about which said second handle pivots with respect to the second turning member, and the first axis, about which said second turning member pivots with respect to connection member, are disposed at a predetermined angle relative to one another which angle is other than zero degrees, wherein the connection member extends along the first axis for rotation of both of the first turning member and the second turning member, wherein the first axis and the second axis are orthogonal to one another.

2. A multi-dimensional training device comprising:

a connection member;

a first turning member connected to a first end of the connection member so as to be rotational during exercise use;

a first handle pivotably connected to the first turning member for free rotation of the first handle relative to the first turning member;

a second turning member connected about a first axis to a second end of the connection member for free rotation during exercise use of the second turning member relative to the connection member;

a second handle pivotably connected about a second axis to the second turning member for free rotation of the second handle relative to the second turning member, wherein the second axis, about which said second handle pivots with respect to the second turning member, and the first axis, about which said second turning member pivots with respect to connection member, are disposed at a predetermined angle relative to one another which angle is other than zero degrees;

further comprising at least a weight member provided on the connection member, between the first handle and the second handle, and between the turning members.

3. The multi-dimensional training device as claimed in claim 2, further comprising at least a cushion member provided on the connection member.

4. A multi-dimensional training device comprising:

a connection member;

a first turning member connected to a first end of the connection member so as to be rotational during exercise use;

a first handle pivotably connected to the first turning member for free rotation of the first handle relative to the first turning member;

a second turning member connected about a first axis to a second end of the connection member for free rotation during exercise use of the second turning member relative to the connection member; and weighted members between the turning members; and a second handle pivotably connected about a second axis to the second turning member for free rotation of the second handle relative to the second turning member, wherein the second axis, about which said second handle pivots with respect to the second turning member, and the first axis, about which said second turning member pivots with respect to connection member, are disposed at a predetermined angle relative to one another which angle is other than zero degrees, wherein a third axis, about which said first handle pivots with respect to the first turning member, and the first axis, about which said second turning member pivots with respect to the connection member, are disposed at a predetermined angle relative to one another which angle is other than zero degrees, wherein the first turning member is an L-shaped plate having a first section, to which the connection member is connected, and a second section, on which the first handle is pivoted, wherein the first axis and the second axis are orthogonal to one another.

* * * * *